United States Patent [19]

Groger et al.

[11] 4,155,599

[45] May 22, 1979

[54] DRIVE GEARS FOR RACK-DRIVEN MINING MACHINE

[75] Inventors: Hans Groger, Essen-Steele-Horst; Dieter Lauterbach; Wolfgang Ruchatz, both of Bochum, all of Fed. Rep. of Germany

[73] Assignee: Gebr. Eickhoff Maschinenfabrik und Eisengiesserei m.b.H., Bochum, Fed. Rep. of Germany

[21] Appl. No.: 863,194

[22] Filed: Dec. 22, 1977

[30] Foreign Application Priority Data

Dec. 22, 1976 [DE] Fed. Rep. of Germany ..... 2658155

[51] Int. Cl.[2] ..... E21C 29/00

[52] U.S. Cl. ..... 299/43; 74/462; 104/165; 105/29 R

[58] Field of Search ..... 299/32, 34, 42, 43; 74/462; 104/165; 105/29 R

[56] References Cited

U.S. PATENT DOCUMENTS

| | | | |
|---|---|---|---|
| 2,652,785 | 9/1953 | Cox | 105/29 R |
| 4,051,492 | 9/1977 | Laskin et al. | 74/462 X |
| 4,054,321 | 10/1977 | Jarvis | 299/43 |

FOREIGN PATENT DOCUMENTS

| | | | |
|---|---|---|---|
| 526821 | 10/1921 | France | 74/462 |
| 1056041 | 1/1967 | United Kingdom | 74/462 |

*Primary Examiner*—Ernest R. Purser

*Attorney, Agent, or Firm*—Thomas H. Murray; Clifford A. Poff

[57] ABSTRACT

Drive gears with unique teeth profiles drivingly couple the output shaft of a drive on a drum-cutter mining machine to a rack extending along the course of travel of the mining machine. A prime mover on the mining machine is coupled to a drive gearwheel having gear teeth with tooth flanks defined by segments of a hypocycloid. These gear teeth mesh with a rack drive gearwheel having gear teeth with tooth flanks defined by segments of an epicycloid. The gear teeth of the rack drive gearwheel have a slender profile to penetrate into the spaces between pins forming part of a guide rail rack.

3 Claims, 2 Drawing Figures

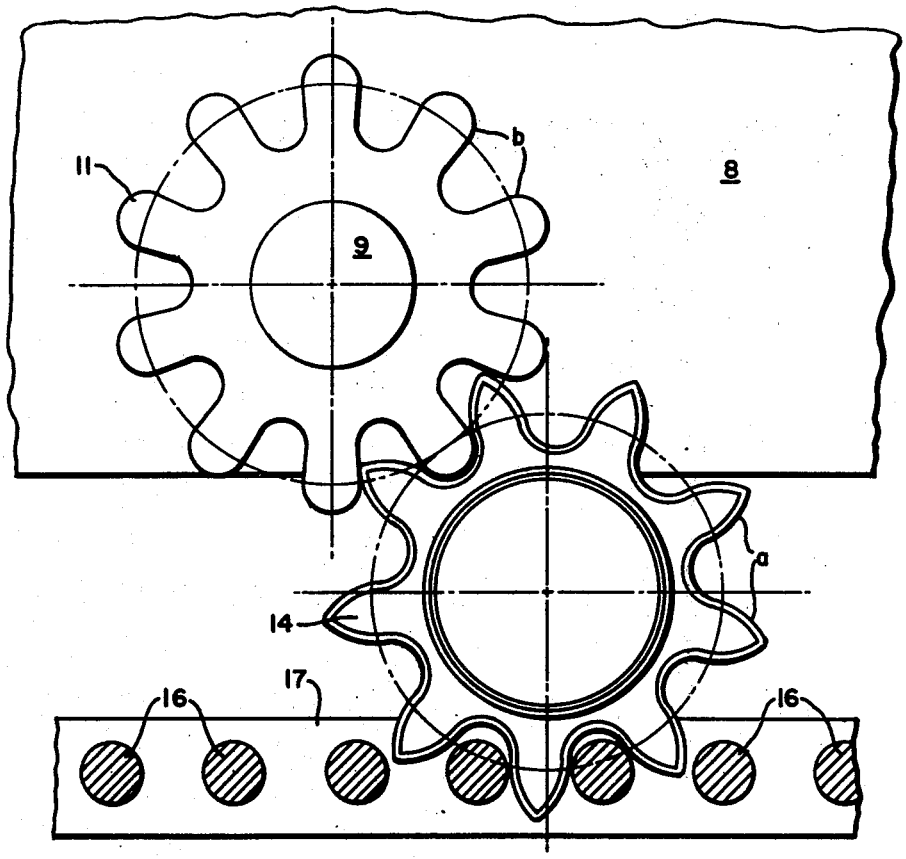

DRIVE GEARS FOR RACK-DRIVEN MINING MACHINE

BACKGROUND OF THE INVENTION

Figure 1:
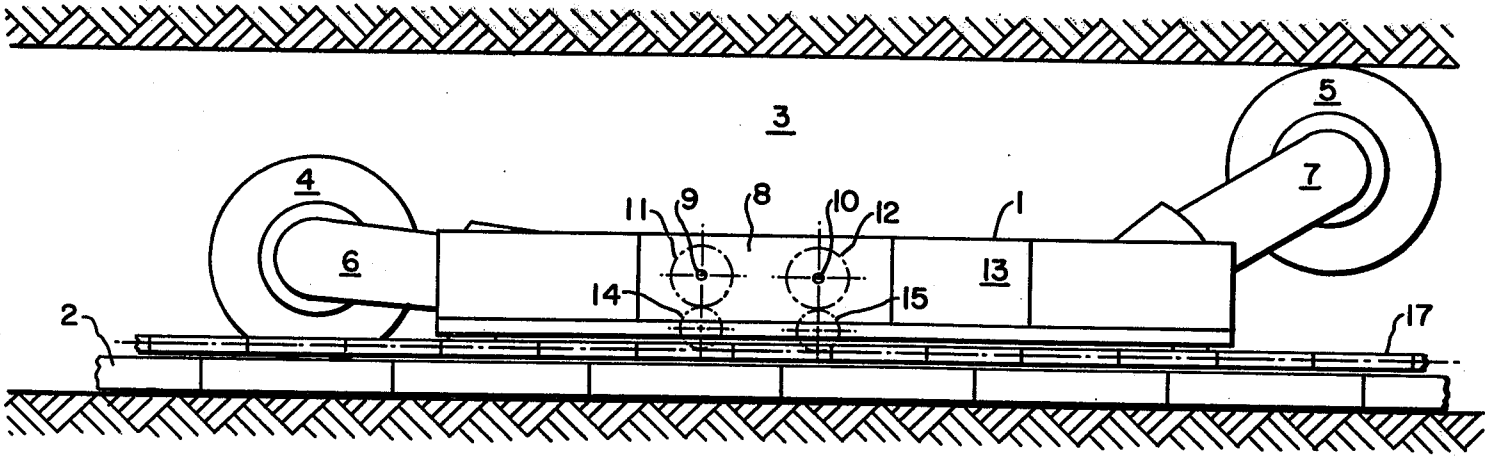

This invention relates to a mining machine for underground mining operations, and more particularly to a drumcutter type mining machine having a drive gearwheel with teeth in meshing engagement with teeth of a drive rack wheel that, in turn, drivingly engages a guide rail rack which extends along the course of travel by the mining machine.

A mining machine of this general type is disclosed in West German Pat. No. 2,543,510. In this prior art form of mining machine, the output shaft of winch on the mining machine carries a drive wheel having teeth which mesh with the teeth of a rack drive wheel which is, in turn, adapted to mesh with drive pins of a rail used for driving the mining machine along its course of travel. The guide rail comprises individual rail parts, each having a length which corresponds to the length of a conveyor trough portion of a face conveyor. The guide rail portions are mounted onto the stow side of the face conveyor. By this construction, the face conveyor and the guide rail are shifted together to carry out the usual advancement toward the working face of an underground mine. During the shifting operation, the individual conveyor trough portions together with the guide rail portions and more particularly those guide rail portions which are mounted on the stow side, are set at a greater or lesser relative angle. As a result, gaps are produced between the guide rail portions and these gaps cause pitch differences between the two driving pins of the guide rail portions which enclose the joint between them. This renders engagement of the drive rack wheel with the rack more difficult, particularly in view of the fact that the tooth flanks of the drive wheel have involute profiles which confer on the teeth a relatively compact shape and a low height. In view of this, the teeth of the drive rack wheel do not mesh with the rack in a manner to provide smooth running of the mining machine which is particularly impaired by the pitch differences occurring at the joints between the guide rail portions.

SUMMARY OF THE INVENTION

It is an object of the present invention to provide an improved gear drive arrangement to consistently maintain a proper meshing relation between a drive rack gearwheel and rack pins on guide rail portions, particularly at joints between such portions where pitch differences between the rack pins occur.

More particularly, according to the present invention, there is provided a drum-cutter mining machine of the type which carries a prime mover coupled to rotate a drive gearwheel which drivingly engages a rack drive gearwheel that, in turn, drivingly engages a guide rail having means forming rack teeth, the guide rail extends along the course of travel by the drumcutter mining machine at the working face of a mine, the combination therewith of the improvement comprising the aforesaid drive gearwheel having gear teeth with tooth flanks defined by segments of a hypocycloid, and the aforesaid rack drive gearwheel having gear teeth with tooth flanks by segments of an epicycloid.

Thus, the present invention provides that a drum-cutter mining machine for underground mining operations is provided with a drive gearwheel having tooth flanks with profiles generated from a curve of a hypocycloid while the tooth flanks of a rack drive gearwheel are generated from a curve of an epicycloid. The teeth of the rack drive gearwheel each have a shape characterized by a particularly tall tip and a slender profile which converges in a relatively pointed fashion with the fillet curve. The slender profiles of these teeth facilitate penetration by the teeth into the gaps occur between the pins defining rack teeth on the guide rail portions. The width of the novel tooth profile for the rack drive gearwheel is reduced from the normal tooth width, while the taller tip of each tooth assures engagement with the drive pins including the pins at the gap between abutted rack segments even when the gap between the pins is larger than the normal spacing of the pins. The novel tooth profile assures that a particular gear tooth will penetrate more deeply into the gap between drive pins while at the same time the mining machine undergoes continued advancing movement along the working direction of the mine face. The gear teeth profiles according to this construction is less sensitive to pitch differences between rack segments than an involute gear tooth profile which is conventionally employed for rack gearwheels heretofore always employed where a rack drive gearwheel engaged a gear rack.

According to further features of the present invention, the same rolling circles are used in the hypocycloid and epicycloid curves used to define teeth flanks of the drive gearwheel and the rack drive gearwheel. This feature enables the utilization of drive gearwheels and rack drive gearwheels with the most diverse number of teeth and paired in a driving relation. This feature is of a particular advantage when encountering differences to the seam thicknesses in a mine. Because of the differences in the seam thicknesses, drum-cutter mining machines always require changes to the frame height and the distance between the winch output shaft and the plane of the rack guide rail. The changes differ from location to location for working on the various face seams. Such changes to drum-cutter mining machines are compensated for by the different diameter and number of teeth of the rack drive gearwheel. It is also possible, without difficulty, to alter the dimensions of the drive gearwheel and to obtain the required feed thrust with drive gearwheels having a different number of teeth to cooperate with the desired rack drive gearwheel.

Figure 2:
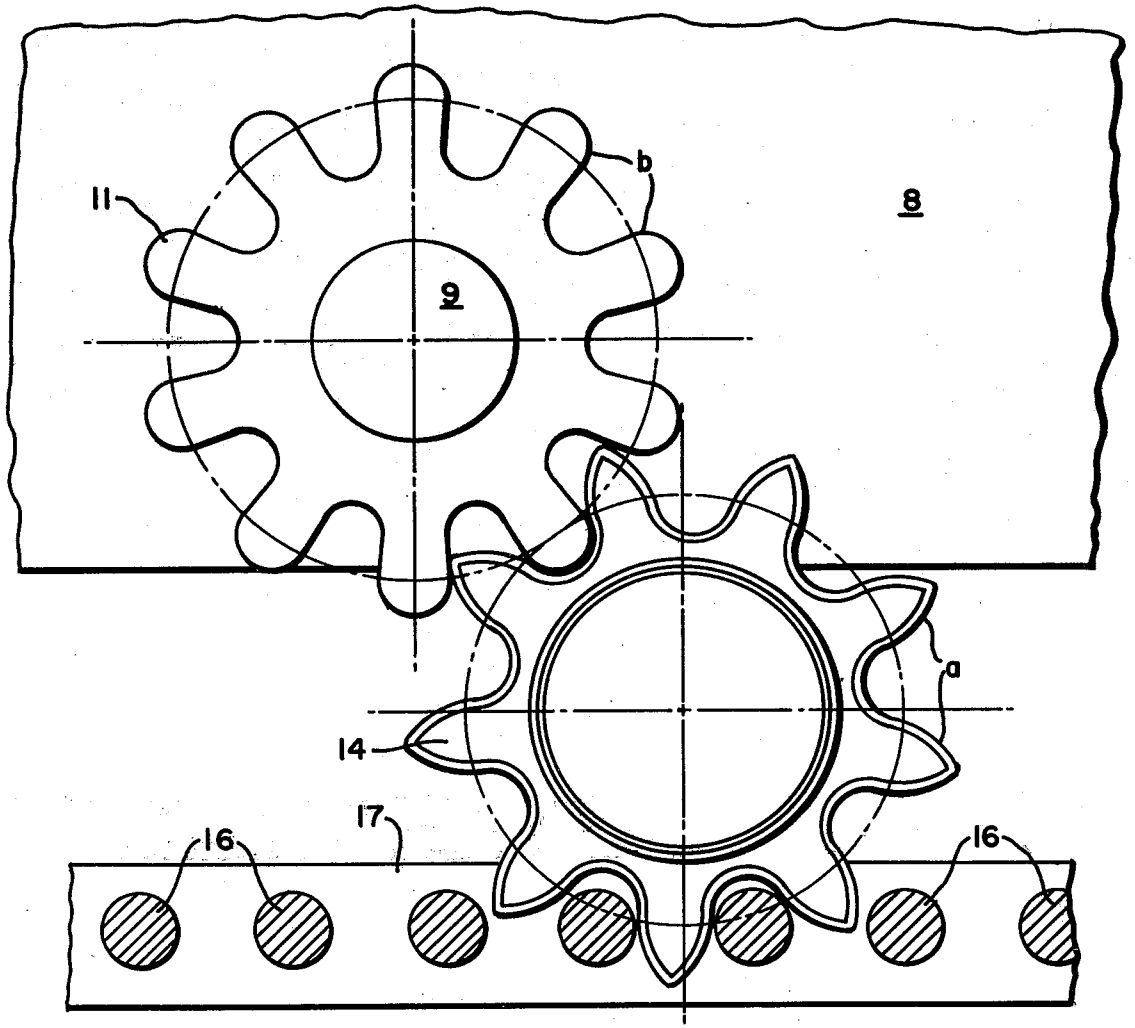

These features and advantages of the present invention as well as others will be more fully understood when the following description is read in light of the accompanying drawings, in which:

FIG. 1 is a side elevational view of a drum-cutter mining machine of the type adapted to be driven by gearwheels embodying the features of the present invention; and FIG. 2 is an enlarged view of the drum-cutter mining machine shown in FIG. 1 to illustrate the novel gearwheel constructions and driving relationship with a rack guide rail.

In FIG. 1, there is illustrated a drum-cutter mining machine 1 traversable upon a face conveyor 2 to release or cut material from a mine face 3 by means of cutting drums 4 and 5. The cutting drums are supported for vertically-adjustable movement by means of arms 6 and 7 at the opposite ends of the mining machine. The mining machine further includes a winch casing 8 arranged between the support arms 6 and 7. Two spaced-apart drive output shafts 9 and 10 emerge from the wall of the winch casing 8 at the stow side. The drive output shafts 9 and 10 are coupled by keys or the like to drive gearwheels 11 and 12, respectively. Each of the drive gearwheels is driven by a hydraulic motor through a step-down transmission, not shown. The hydraulic motors are coupled to a common fluid pump which is, in turn, coupled to a prime mover 13 for the drum-cutter machine 1 and associated with the winch 6. Drive gearwheels 11 and 12 mesh with rack drive gearwheels 14 and 15, respectively. As shown in FIG. 2, gearwheels 14 and 15 are disposed below the respective gearwheels 11 and 12 so that the gear teeth of gearwheels 14 and 15 mesh with the respective gearwheels 11 and 12 and with underlying rack teeth formed by means including pin 16 supported by guide rails 17. The drive pins 16 extend parallel and in spaced-apart relation along the guide rail which includes, in a manner per se known in the art, rack guide rail segments arranged in an abutted, end-to-end relationship to extend along the course of travel by the drum-cutter mining machine. The guide rail segments arranged in this manner are mounted onto the side wall of the face conveyor 2 and extend in a parallel relation therewith.

In accordance with the present invention, the tooth flanks a of the rack drive gearwheels 14 and 15 are formed as segments of epicycloids. The teeth of gearwheels 14 and 15 do not merely have a relatively tall tip height but also a particularly slender profile. The teeth compensate for differences of pitch between driving pins 16 at the abutted ends of rack guide rail segments. Thus, even though the rack guide rail 17 is divided into segments, the drum-cutter mining machine is smoothly propelled without noticeable defects because of differences to the pitch between successively-arranged drive pins 16. The drive gearwheels 11 and 12 which mesh with the respective rack drive gearwheels 14 and 15 are provided with teeth having flanks b which are formed as segments of hypocycloids. In the preferred form of the present invention, the same rolling circles are used to generate the hypocycloid and epicycloid curves that define the profile of the tooth flanks b and a, respectively. Drive gearwheels and rack drive gearwheels may be paired in a driving relation by employing widely different numbers of teeth for the paired gearwheels without difficulty. As noted hereinbefore, the teeth of the rack drive gearwheels 14 and 15 have particularly tall tips and slender profiles. The tooth flanks a converge in a relatively pointed fashion with the fillet curve which is the concave portion of the tooth profile where it joins the bottom of the tooth space.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. In a drum-cutter mining machine of the type which carries a prime mover coupled to rotate a drive gearwheel which drivingly engages a rack drive gearwheel that, in turn, drivingly engages a guide rail having means forming rack teeth, said guide rail extending along the course of travel by said drum-cutter mining machine at the working face of a mine, the combination therewith of the improvement comprising said drive gearwheel having gear teeth with tooth flanks thereof defined by segments of a hypocycloid, and said rack drive gearwheel having gear teeth with tooth flanks thereof defined by segments of an epicycloid.

2. The improvement according to claim 1 wherein said hypocycloid and epicycloid are generated about rolling circles having the same diameter.

3. The improvement according to claim 2 wherein said means forming rack teeth includes drive pins at parallel and spaced-apart locations along each of a plurality of guide rack segments arranged in an end-to-end relation to extend along the course of travel by said drum-cutter mining machine.

* * * * *